US009636807B2

(12) United States Patent
Bills

(10) Patent No.: US 9,636,807 B2
(45) Date of Patent: May 2, 2017

(54) PLUMBING INSERT REMOVAL TOOL

(71) Applicant: Rodney Bills, Canfield, OH (US)

(72) Inventor: Rodney Bills, Canfield, OH (US)

( * ) Notice: Subject to any disclaimer, the term of this patent is extended or adjusted under 35 U.S.C. 154(b) by 352 days.

(21) Appl. No.: 14/534,643

(22) Filed: Nov. 6, 2014

(65) Prior Publication Data

US 2015/0059146 A1 Mar. 5, 2015

Related U.S. Application Data

(63) Continuation of application No. 13/302,102, filed on Nov. 22, 2011, now abandoned.

(60) Provisional application No. 61/418,011, filed on Nov. 30, 2010.

(51) Int. Cl.
*B25B 13/54* (2006.01)
*B25B 13/48* (2006.01)

(52) U.S. Cl.
CPC ..... *B25B 13/54* (2013.01); *B25B 13/48* (2013.01); *Y10T 29/49822* (2015.01)

(58) Field of Classification Search
CPC ..... B25B 13/5083; B25B 13/54; B25B 13/48; B25B 15/008; B25B 23/105; B25B 13/06; B25B 5/147; B25B 7/00; B25B 7/16
See application file for complete search history.

(56) References Cited

U.S. PATENT DOCUMENTS 2,482,501 A * 9/1949 Oravetz ..... B25B 13/5083 81/446
5,622,091 A * 4/1997 Crook ..... B25B 13/48 81/441
6,343,411 B1 * 2/2002 Sigman ..... B25B 13/44 29/263
6,675,679 B2 * 1/2004 Dugan ..... B25B 13/5083 81/442

* cited by examiner

*Primary Examiner* — Robert Scruggs
(74) *Attorney, Agent, or Firm* — Robert G. Lev

(57) ABSTRACT

An internal plumbing wrench is arranged for internally gripping a plumbing insert, such as those used in sinks and the like. The internal wrench includes a split gripping section which is adjustable by the cam action of a hexagonal core. A central shaft has a foot extending 90° away from the longitudinal axis of the shaft and is arranged to extend into pipes connected to the insert to hold a broken pieces and permit separation of the insert from any pipe pieces attached thereto.

16 Claims, 4 Drawing Sheets

FIG. 4
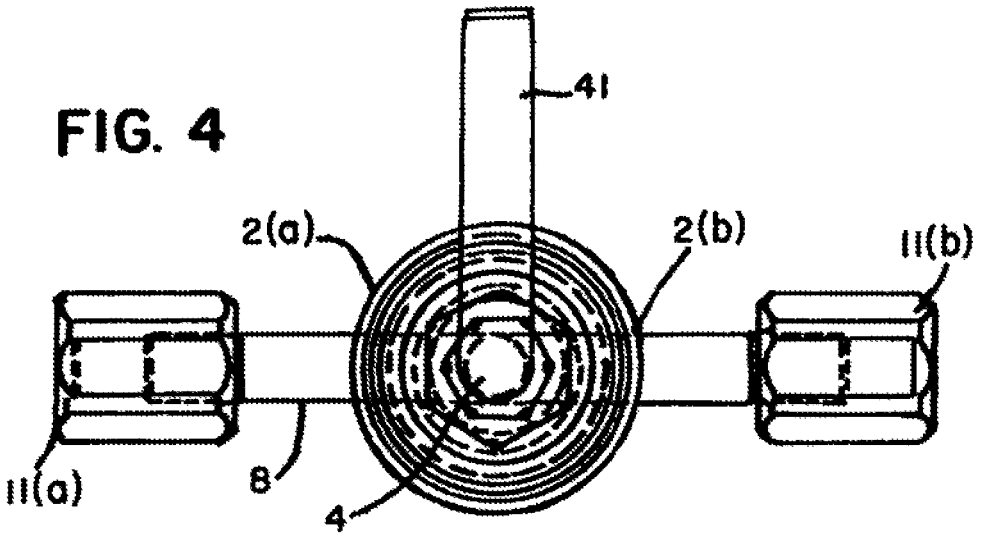
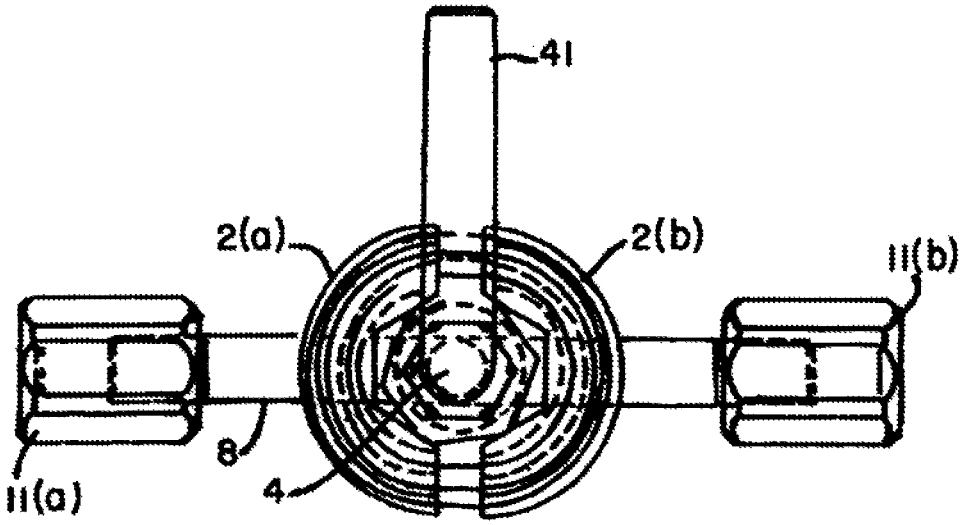
FIG. 5

PLUMBING INSERT REMOVAL TOOL

PRIORITY INFORMATION

The subject patent application claims priority as a continuing application to U.S. patent application Ser. No. 13/302,102, filed Nov. 22, 2011. The present invention also claims priority to U.S. Provisional Patent Application No. 61/418,011 filed on Nov. 30, 2010, making reference herein to same in its entirety.

FIELD OF INVENTION

The present invention pertains generally to tools for gripping the interior of cylindrical bodies. In particular, the present invention is directed to a tool capable of removing plumbing inserts, such as drain inserts, from pipes ends.

BACKGROUND ART

In endeavors (such as plumbing) that deal with pipes, tubes or other cylindrical objects, it is common to use threaded inserts for end pieces, and the like. When threaded connections are used, the threads are often designed so that the taper of the threads forces internal and external threads to seal against each other to affect a tightly sealed joint capable of holding water, gas, or the like. In order to assure a tight seal, the installer will apply as much force as possible to affect proper air tight or water tight integrity in the system. In many applications, a glue, sealing compound, or putty is applied to the threads or near the threads at the time of installation. This is particularly prevalent for systems containing gas or volatile substances. While this is considered an excellent approach at the time of installation, the use of sealing compounds or the like to effect tight connections also introduces subsequent problems.

Pipe and tube systems are not invulnerable, and thus, deterioration can be expected to take place from a variety of causes. This means that maintenance must be performed, very often with the removal for cleaning or replacement, of various parts of the system, including connected pipes or tubes. Even if the system is being "scrapped", parts of the system may still be useful, and thus salvage is desirable with as little damage as possible. Accordingly, non-destructive disassembly of the system is very desirable, where possible. Unfortunately, non-destructive disassembly can be impossible when pipes or tubes rust or corrode, rendering threaded connections (especially those treated with joining compound) as virtual unitary masses.

Conventional tools, in particular various types of wrenches, used for installation of pipes, tubes and the like are seldom adequate for breaking the seal in threaded joints created by solidified joint compound or/and corrosion. Exterior wrenches (such as pipe wrenches and the like) are often difficult to use in close quarters when applying the forces necessary to break a sealed threaded connection. Further, even when a sufficient force can be applied, the body of the tube or pipe is more likely to break than the sealed, reinforced sections at the threaded connection.

When threaded connections are sealed and cannot be broken, a number of solutions are known in the plumbing or pipe fitting art. One traditional solution is simply to cut away the sealed joints, thereby sacrificing that portion of the system with regard to recycling, and perhaps damaging other parts. The cost for this waste is generally fairly slight, at least in terms of material. However, the cost in the time expended by skilled workers in cutting away the sealed joints is considerable. As a result, the cost for dealing with the disassembly, maintenance or repair of a pipe or tube system can be as great as the original installation of this system. This can be disastrous in terms of maintaining low cost levels for repair, salvage, and the like.

Of particular difficulty are drain inserts for tubs, sinks or other structures which interface with the end of a pipe, and form a seal between the sink and the end of the pipe. When a threaded joint between a drain insert and the pipe terminating at the drain insert becomes locked (by means of corrosion and/or compound) so that it cannot be rotated, special problems occur with regard to maintenance, repair or replacement. The standard method of cutting a pipe using a hacksaw does very little good with regard to removing the drain insert, even if cutting the pipe is a necessary preliminary step for removing the drain insert. Cutting out a drain insert is difficult, time consuming, and very often results in a damaged sink or other vessel.

One example of a cutting tool for removing drain inserts or assemblies is found in U.S. Pat. No. 5,946,990 to Bonacci, (incorporated herein by reference). Those who have used such arrangements attest to the difficulty and costs of removing drain inserts by such techniques. Even a skilled practitioner is liable to damage a salvageable sink or other vessel, and entirely destroy the threaded end of the feed pipe, necessitating substantial replacement, as well as labor costs.

Another arrangement is the use of internal wrenches. A wide variety of internal wrench arrangements have been used. These include: U.S. Pat. No. 6,343,411 to Sigman; U.S. Pat. No. 7,024,972 to Werner et al.; U.S. Pat. No. 4,499,799 to Bordages; U.S. Pat. No. 6,874,393 to Kile; U.S. Pat. No. 5,257,559 to Cannetti; U.S. Pat. No. 6,282,999 to Hite et al; U.S. Pat. No. 2,956,461 to Anderson; and, U.S. Pat. No. 6,675,679 to Dugan. All of these devices and systems are incorporated herein by reference.

Of all of these designs, argueably the most effective is found in U.S. Pat. No. 6,675,679, to Dugan. This design employs a gripping device, having a split shell, which is adjusted for gripping the interior of a pipe or tube through the use of a cam like structure. While the subject device disclosed in the Dugan patent has proven largely superior to other systems for removing drain inserts, there are still difficulties in the actual operation of the Dugan arrangement. Firstly, the gripping adjustment of the Dugan arrangement is difficult to maintain when attaching the external wrench necessary to separate the drain insert from the feed pipe. Even skilled practitioners have difficulty operating the Dugan arrangement in an expeditious and satisfactory matter. Generally, more than two hands are needed to hold the Dugan device in a gripping position and then place the external wrench on the device for operation.

Another problem with the Dugan arrangement, as well as the other conventional arrangements cited and incorporated by reference, results from pipe deterioration, which is frequently the situation when repair, maintenance or recovery are being conducted. In particular, rusted or otherwise deteriorated pipes tend to break easily, especially near the L-shaped section at the drain insert. When this happens, the internal wrench of Dugan (or one of the other arrangements from the cited art) will operate to spin the broken end (L-shaped section) of the pipe, without separating it from the drain insert. When this happens, conventional cutting of the drain insert is the only course to take. When this happens, the whole purpose of the relatively expensive and complex internal wrench of Dugan has been undermined.

Accordingly, the art of internal pipe wrenches, especially those used to remove drain inserts, admits to a substantial improvement. For example, such an improvement would facilitate the continued use of the internal wrench without cutting, even with a broken pipe. Further, such improvements would include the facilitation of easy adjustable gripping and operation.

SUMMARY OF INVENTION

Accordingly, it is a primary goal of the present invention to overcome major drawbacks of conventional pipe and tube wrenches, holding devices and other manipulating devices.

One object of the present invention is to provide an internal pipe wrench that is easy to manipulate, and can be operated properly by only one person.

It is another object of the present invention to provide an internal pipe wrench that is self-contained with respect to different sizes of pipes and tubes to be handled.

It is a further object of the present invention to provide an internal pipe wrench requiring minimal manipulation in placement of the internal wrench, and actual operation of the internal wrench, with or without an external torque application device.

It is an additional object of the present invention to provide an internal pipe wrench that has the capability of removing an insert when the pipe is broken.

It is still a further object of the present invention to provide an internal pipe wrench which requires a minimum amount of space in which to operate.

It is yet a further object of the present invention to provide an internal pipe wrench which can be placed in the operational mode on a pipe, and then easily adjusted to provide torque, with or without the aid of external torque application devices.

It is again an additional object of the present invention to provide an internal pipe wrench which facilitates the application of torque from a wide variety of different directions, angles and sources.

It is still another object of the present invention to provide an internal pipe wrench which facilitates even gripping along the inner circumference of the pipe.

It is yet a further object of the present invention to provide an internal pipe wrench in which deployment of the wrench is easily facilitated under all circumstances.

It is again an additional object of the present invention to provide an internal pipe wrench which can easily accommodate multiple pipe sizes automatically, and without the addition of separate parts.

It is still a further object of the present invention to provide an internal pipe wrench which automatically moves from the gripping position to a neutral position when desired.

It is again another object of the present invention to provide an internal pipe wrench having a structure to uniformly support gripping structures having the entire circumference of the pipe.

These and other goals and objects of the present invention are achieved by an internal pipe wrench having a gripping section. The wrench also includes a core section operable to adjust the gripping section. Further, included is a central shaft having a substantially 90° foot extending away from the core section and gripping section.

BRIEF DESCRIPTION OF DRAWINGS

FIG. 4 is a top view of the present invention in a first position.

FIG. 5 is a top view of the present invention in a second position.

DETAILED DESCRIPTION OF PREFERRED EMBODIMENTS

Figure 1:
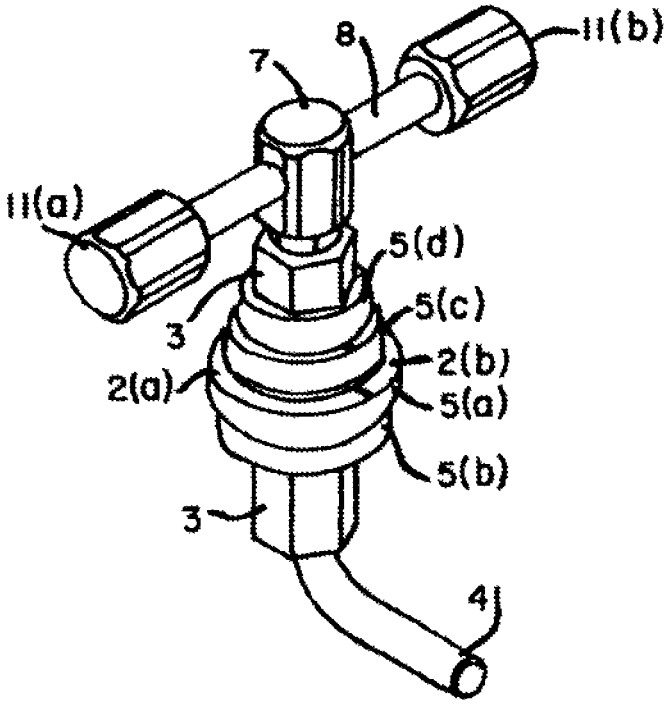
FIG. 1 is a perspective view of the present invention.
Figure 2:
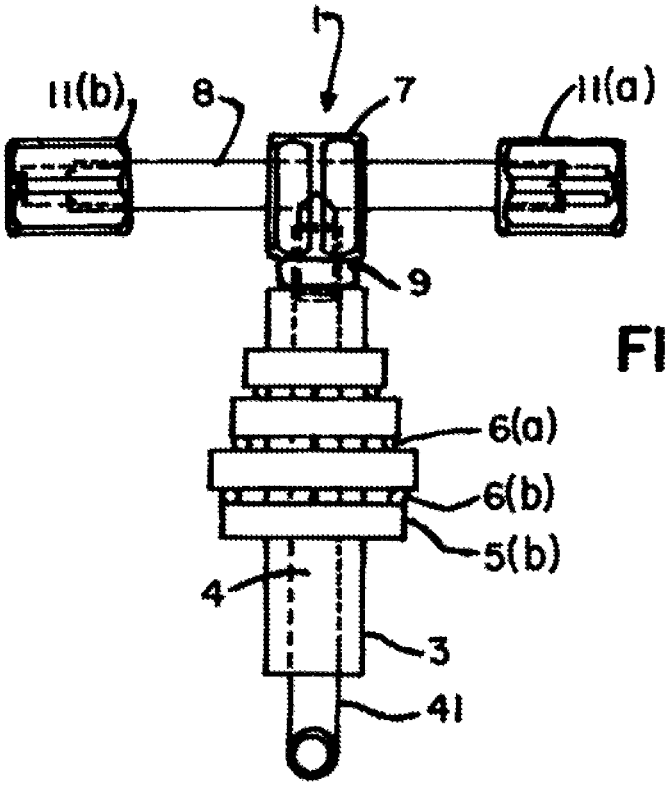
FIG. 2 is a front view of the present invention.
Figure 3:
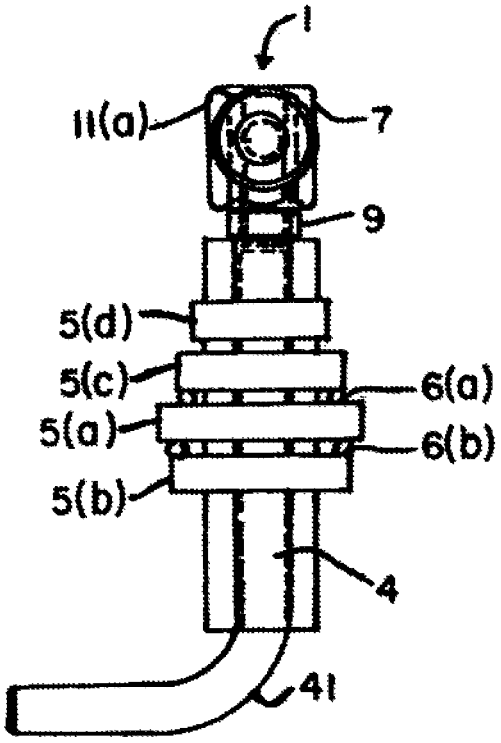
FIG. 3 is a side view of the present invention.
Figure 6:
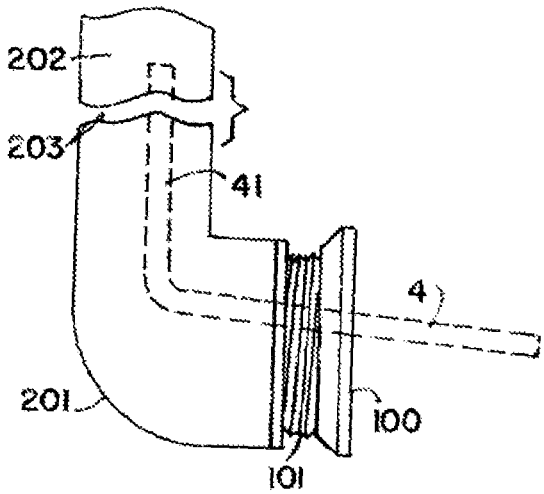
FIG. 6 depicts the environment in which a portion of the present invention is placed.

The present invention as depicted in the perspective view of FIG. 1 is an internal pipe wrench 1 meant to grip the interior of a pipe or other tube like structure (FIG. 6). One particular embodiment of the present invention is directed to the removal of drain inserts (100 in FIG. 6) at the end of a pipe section (201 in FIG. 6) feeding a sink or other vessel (not shown). As previously discussed, such inserts corrode or have "frozen" threads that make "unscrewing" of the insert for removal all but impossible. The first embodiment of the present invention is specifically directed to such a situation.

The present invention is internal pipe wrench 1, particularly suited to the situation in FIG. 6. In this arrangement, the pipe at the L-section 201 extending to a sink or other vessel (not shown), and capped with the drain insert 100 is broken. In such a situation a conventional internal wrench would be unable to remove the drain insert 100 from the L-shaped pipe section 201 because the broken L-section 201 would simply spin without allowing the drain insert to be "unscrewed" from L-section 201. Conventionally, this would necessitate cutting the drain insert 100, a long and expensive process.

The aforementioned situation is specifically addressed by a novel aspect of the present inventive interior wrench 1. In particular, the 90° foot 41 from the main shaft 4 of the present invention, is specifically designed to extend so as to bridge the break 203 between the L-shaped section 201 and the rest of the pipe 202, thereby preventing the spinning of the L-shaped section 201 while attempting to unscrew the drain insert 100 from the L-shaped 201 section.

The perpendicular foot 41 is part of the main shaft 4, which extends through the body of the internal wrench 1. The end 42 of central shaft 4 opposite of the perpendicular foot 41 is threaded to accommodate a threaded T-joint 7 and a locking nut 9. The central shaft 4 rotates freely within a hex-shaped core 3. The hex-shaped core 3 operates to force apart two shell halves 2(*a*), 2(*b*). Each shell half contains a plurality of split gripping discs 5(*a*), 5(*b*), 5(*c*), 5(*d*) of different diameters. The use of different sizes for the various split gripping discs permits a wide variety of different pipe diameters to be accommodated.

The hex-shaped core 3 closely fits inside of the two shell haves 2(*a*), 2(*b*). This provides a very tight fit between the hexagonal core 3 and the two shell halves 2(*a*), 2(*b*). The hexagonal core 3 rotates relative to the two shell halves 2(*a*), 2(*b*), so as to force the two shell halves apart wherein the hexagonal core 3 operates as a cam. The hexagonal shape of core 3 provides superior support for the two shell halves 2(*a*), 2(*b*) because of the multiple points of contact during the cam operation. This makes the cam operation far easier to affect, as well as providing superior overall support between the hexagonal core 3 and the two shell halves 2(*a*), 2(*b*). The ultimate result is a much tighter grip of the interior of the pipe by gripping discs 5(*a*), 5(*b*), 5(*c*), 5(*d*). Far less effort is needed to place the internal wrench 1 in the proper position for operation.

The use of a hexagonal core 3 as a cam to force the two shell halves apart, means that a wide variety of incremental sizes can also be accommodated so that the gripping discs do not have to be exactly sized to accommodate any particular pipe size. All of this is accomplished with little effort.

The T-joint 7 accommodates a sliding gripping handle 8 with threaded holding knobs 11(*a*), 11(*b*) attached at either end. The arrangement of the sliding gripping handle 8 allows adjustment and operating torque to be applied from a wide variety of different angles and positions. This arrangement accommodates easy adaptation to a wide variety of situations.

The T-joint 7 is hexagonal in shape and preferably made of such a size that external wrenches can be easily fitted there over. The sliding handle 8 is easily removable so that external tools for applying torque can be easily used. The T-joint 7 can be used to apply torque to the internal pipe wrench 1. Further, the T-joint 7 can be removed altogether and an external torque tool (not shown) can be attached via the threaded end 42 of the central shaft 4.

In another alternative, an external wrench (not shown) can be fit over the hexagonal core 3 in order to apply torque to operate internal pipe wrench 1 to loosen drain insert 100 from the connecting L-shaped section 201. The hexagonal core 3 is sized to accommodate standard tool sizes.

The use of the perpendicular foot 41 extending from the central shaft 4 permits much easier adjustment of internal pipe wrench 1 when being fitted to a drain insert. The perpendicular foot 41 holds the pipe 202 extending away from the L-shaped section 201 extending to the drain insert 100. This means that an operator can more easily effect gripping of the internal pipe wrench 1 to the drain insert 100. Without perpendicular foot 41, this would be a difficult process due to the spring-like action of the holding gaskets 6(*a*), 6(*b*) arranged around the circumference of the two shell halves 2(*a*), 2(*b*) in a manner which pulls the two shell halves 2(*a*), 2(*b*) together unless forced apart by the cam action of the hexagonal core 3. When applying torque to the threaded top 42 of the central shaft 4, and the hexagonal core 3 simultaneously, the entire wrench 1 is held in place by the perpendicular foot 41 so that the appropriate gripping discs 5(*a-d*) can be secured to the internal diameter of the drain insert 100. This requires a minimum of manipulation on the part of the operator. This also facilitates easier overall removal of the drain insert 100, requiring less time and effort to perform this normally difficult operation.

Placement of the interior wrench 1 is further facilitated in that the expansion of the two shell halves 2(*a*), 2(*b*) takes place with a rotation of the hexagonal core 3 in the same direction in which rotation of the interior wrench 1 will be used to unscrew drain insert 100. As a result, the same rotational movement that forces the interior wrench 1 to grip the interior of drain insert 100 is also the same rotation that begins removal of the drain insert 100. This operation can often be carried out using one hand because perpendicular foot 41 holds the device in position while the necessary rotation takes place.

Likewise, the extension of the perpendicular foot 41 into the pipe 202 leading to the L-shaped section 201 becomes very important when pipes break, as they often do under the stresses of removing the drain insert 100. External torques on the drain insert 100, tend to cause failure at the weakest points in the connective system. This is usually the lead pipe 202 (shown as being broken and separated in FIG. 6), which is much weaker than the threaded structure of the L-shaped section 201 at which the drain insert 100 is mounted.

Normally, when a pipe breaks (203) as depicted in FIG. 6, even the best internal wrench could do nothing but spin the L-shaped section 201 of pipe without separating it from the drain insert 100. Normally, under such circumstances a practitioner would be forced to find some way of gripping the L-shaped section 201 while operating the internal wrench. This is both awkward (sometimes to the point of impossibility), and unreliable. Normally, the means to grip the L-shaped section will cause the rest of the pipe to collapse while sufficient torque is being applied to operate the internal wrench. Ultimately, the operator will be forced into a long, difficult and somewhat destructive cutting process. This is the result that the first embodiment of the present invention is directed to avoiding.

The perpendicular foot 41 extends into the lead pipe 202 to hold the overall structure together while torque is applied to remove the drain insert 100 from the L-shaped section 201 of the pipe. The perpendicular foot 41 exerts pressure along the length of the lead pipe 202 and the L-shaped section 201 so as to avoid the concentration of force (such as that which would be found with heavy pliers or channel locks) in order to avoid further damaging of either the lead pipe 202 or the L-shaped section 201.

While the present invention is best employed as previously described, its uses are not limited thereto. The present invention can be applied to any number of tubes or pipe like structures for a wide variety of uses that require the manipulation or holding of a pipe or a pipe fitting. Any kind of tubular or semi-tubular structure is appropriate for application by the present invention.

Accordingly, the present invention should be interpreted as encompassing any and all improvements, variations, permutations, modifications, derivations, applications, evolutions and embodiments that would occur to ones skill in this art having possession of the teachings of the present application. Therefore, the present invention should be construed as being limited to only by the following claims.

I claim:

1. An internal wrench configured to operate in an environment including of a first run of pipe with an open end having an insert with a threaded connector attached to the open end, the first run of pipe extending in a first direction, a second run of pipe extending in a second direction approximately 90° from the first direction, wherein the first and second runs of pipe are connected by a substantially 90° angle connector, structurally configuring the first and second runs of pipe so that a torque applied at the open end of the first run of pipe creates a potential breaking point along the second run of pipe; said internal wrench comprising:

a) a split gripping section;

b) a core section having a longitudinal axis and arranged within said split gripping section, the core section being operable to adjust separation characteristics of said split gripping section;

c) an elongated central shaft arranged within said core section along the longitudinal axis of the core section; and, d) a foot section extending from the elongated central shaft in a direction substantially 90° from the longitudinal axis of the core section, and comprising means for holding said second run of pipe by applying distributed force along said second run of pipe on either side of said potential breaking point and preventing rotation of said first run of pipe when torque is applied at said open end of said first run of pipe.

2. The internal wrench of claim 1, wherein said elongated central shaft rotates within said core section.

3. The internal wrench of claim 2, wherein said central core section has an outer hexagonal shape.

4. The internal wrench of claim 3, further comprising:

e) a first holding mechanism for rotating said elongated central shaft.

5. The internal wrench of claim 4, wherein said first holding mechanism comprises a removable T-handle connected to a first end of said central shaft opposite said foot section.

6. The internal wrench of claim 4, further comprising:

f) a second holding mechanism for rotating said core section, said second holding mechanism located adjacent said first holding mechanism for said central shaft.

7. The internal wrench of claim 6, wherein said second holding mechanism comprises a hex-shaped interface.

8. The internal wrench of claim 3, wherein said split gripping section comprises multiple split discs having different diameters.

9. The internal wrench of claim 8, wherein said multiple split discs have outer, annular surfaces configured for gripping an interior surface of said insert.

10. The internal wrench of claim 8, further comprising:

g) a spring mechanism arranged around said split gripping section and configured to hold said split gripping section together against force generated by rotation of said core section.

11. The internal wrench of claim 10, wherein said spring mechanism comprises multiple, elastic bands formed on said split discs.

12. The internal wrench of claim 3, wherein said multiple split discs are configured in two halves so that rotation of said core section separates said two halves from each other.

13. A method of using an internal wrench to remove an insert from an open end of a first pipe run in a multi-pipe structure, the multi-pipe structure including at least a first run of pipe extending in a first direction and having the open end with the insert, the multi-pipe structure further including a second run of pipe extending in a second direction approximately 90° from the first direction, the first run and second run of pipe being connected by a substantially 90° connector, structurally configuring the multi-pipe structure so that a torque applied to the open end of the first run of pipe creates a potential breaking point along the second run of pipe, the internal wrench including a split gripping section, a core section arranged within the split gripping section, an elongated central shaft arranged within the core section along the longitudinal axis of the core section and a foot section extending from the elongated central shaft in a direction substantially 90° from the longitudinal axis of the core section, said method comprising the steps of:

a) inserting said internal wrench to align at least part of said gripping section within said insert, and extending said foot section to extend 90° from longitudinal axis of the core section into said second run of pipe;

b) gripping said insert by expanding said gripping section through a rotational movement of the core section; while holding the central shaft so that said foot section maintains distributed force along the second run of pipe on either side of said potential breaking point, thereby preventing rotation of said first run of pipe when torque is applied at said open end of said first run of pipe; and, c) rotating said central core while gripping an interior said insert so that said insert is rotated out of said open end of said first run of pipe without rotating said first run of pipe.

14. The method of claim 13, wherein said sub-step (c) includes a sub-step of attaching a wrench to said central core while maintaining a separate hold on said central shaft.

15. The method of claim 14, wherein the step (a) includes a sub-step of adjusting said internal wrench vertically to select an appropriate gripping section thickness for gripping the interior of said insert.

16. The method of claim 15, wherein the step (b) further includes a sub-step of separating split discs constituting said gripping section of said internal wrench.

* * * * *